US006533109B1

(12) United States Patent
Grossmann et al.

(10) Patent No.: US 6,533,109 B1
(45) Date of Patent: Mar. 18, 2003

(54) METHOD OF AND APPARATUS FOR CONTROLLING ACCESS TO GROUPS OF ROD-SHAPED SMOKERS' PRODUCTS IN A PACKING MACHINE

(75) Inventors: Jürgen Grossmann, Wentorf (DE); Peter Albrecht, Hamburg (DE)

(73) Assignee: Topack Verpackungstechnik GmbH, Schwarzenbek (DE)

( * ) Notice: Subject to any disclaimer, the term of this patent is extended or adjusted under 35 U.S.C. 154(b) by 73 days.

(21) Appl. No.: 09/686,978

(22) Filed: Oct. 12, 2000

(30) Foreign Application Priority Data

Oct. 12, 1999 (DE) ..... 199 49 072

(51) Int. Cl.[7] ..... B65G 21/00

(52) U.S. Cl. ..... 198/860.5; 198/735.3; 198/812

(58) Field of Search ..... 198/860.5, 860.3, 198/735.3, 735.5, 812, 594; 193/3, 25 FT

(56) References Cited

U.S. PATENT DOCUMENTS 407,421 A * 7/1889 Stewart ..... 14/29
430,935 A * 6/1890 Edwards ..... 14/2.4
3,878,936 A * 4/1975 Niggemyer ..... 198/860.2
4,085,568 A 4/1978 Focke et al.
5,228,266 A 7/1993 Focke
5,247,820 A * 9/1993 Panaccione ..... 198/600
5,931,288 A * 8/1999 Avery ..... 104/139

FOREIGN PATENT DOCUMENTS

DE 24 39 192 3/1976

* cited by examiner

*Primary Examiner*—Christopher P. Ellis
*Assistant Examiner*—Richard Ridley
(74) *Attorney, Agent, or Firm*—Robert Kinberg; Venable

(57) ABSTRACT

An elongated bridge-like member which normally assumes an operative position in which it prevents access to a track for the advancement of finished or partly finished cigarette packs between two successive stations in a packing machine is designed to have its length reduced prior to being movable—without colliding with parts at the stations—from the operative position to an inoperative position in which the track and the cigarette packs in the track are accessible. To this end, the bridge-like member has two carriages each of which includes one of the two end portions of the fully extended bridge-like member; each carriage is movable toward the end portion forming part of the other carriage. A locking device must be disengaged in order to permit movement of the bridge-like member from the operative to the inoperative postion.

42 Claims, 5 Drawing Sheets

METHOD OF AND APPARATUS FOR CONTROLLING ACCESS TO GROUPS OF ROD-SHAPED SMOKERS' PRODUCTS IN A PACKING MACHINE

CROSS-REFERENCE TO RELATED CASES

This application claims the priority of the corresponding German patent application Serial No. 199 49 072.4 filed Oct. 12, 1999. The disclosure of the aforesaid priority application, as well as the disclosure of each and every US and/or foreign patent and/or patent application identified in the specification of the present application, is incorporated herein by reference.

BACKGROUND OF THE INVENTION

The invention relates to improvements in machines for the treatment of successive commodities of a series of commodities during transport between successive treating stations and, if necessary, past one or more intermediate stations. More particularly, the invention relates to improvements in methods and apparatus which can be put to use in packing machines wherein successive commodities must be advanced, in a predictable manner, from an upstream treating station to a downstream treating station through one or more intermediate treating stations. Examples of such machines are cigarette packing machines wherein successive packs or portions of packs must be conveyed toward, through and beyond two or more successive stations wherein the packs and/or their constituents are manipulated by folding, adhesive applying, heating, cooling, label applying and/or other instrumentalities, often at a high or extremely high frequency.

A modern cigarette packing machine normally turns out box-shaped containers known as soft packs or hinged-lid packs. Each such pack contains an array or group of parallel plain or filter cigarettes and one or more envelopes which surround the array and can be made of metalic foil (such as tin foil), paper, transparent or translucent plastic sheet stock, cardboard and/or other suitable wrapping material. For example, the method and the apparatus of the present invention can be put to use and embodied in cigarette packing machines which are known as COMPAS 500 and are distributed by the assignee of the present application.

It is often necessary to advance successive commodities in the form of partly finished or finished cigarette packs along an elongated path which is defined by a group of suitable parts in a packing machine, particularly along a path which is defined in part by an elongated track in conjunction with a cover, bridge, lid or a similar guide member which overlies or underlies or is otherwise associated with the track to ensure predictable advancement of successive commodities between successive treating or processing stations in the packing machine. For the sake of simplicity, the aforementioned guide member will be referred to as bridge or elongated bridge but with the understanding that such bridge can be located above, below or along-side the path for successive commodities of a series of such commodities.

As a rule, or in many instances, a conventional bridge which is put to use in a cigarette packing machine is dimensioned in such a way that one of its end portions is or can be closely or immediately adjacent one or more parts at a first article processing station and that the other end portion of the bridge is or can be closely or immediately adjacent one or more parts at a second article processing station. Such selection of the length and of the mounting of the bridge in a packing machine or in a production line which employs one or more packing machines for cigarettes or the like can create problems when it becomes necessary to remove the bridge or to move the bridge out of the way (i.e., away from its customary operative position) because the one and/or the other end portion of the bridge is likely to collide with the part(s) at the adjacent station; this can result in damage to and in lengthy interruptions of operation of the packing machine or of the entire production line. Each interruption entails huge losses in output because a modern packing machine (such as the aforementioned COMPAS 500) is set up to turn out at least 500 cigarette packs (each of which normally contains twenty cigarettes) per minute.

Thus, if a packing machine for plain or filter cigarettes is designed to employ one or more apparatus wherein a bridge cooperates with (such as overlies or underlies) a track for predictable advancement of partly finished or finished commodities between a pair of successive treating or processing stations (e.g., a track defining a path wherein the blanks for the making of cigarette packs advance along one or more pasters which provides or provide selected portions (such as flaps, panels, tucks, walls or like parts) with coats or films of a suitable adhesive), even a short-lasting stoppage of such apparatus can entail huge losses in output and the making of large numbers of rejects (e.g., packets including blanks carrying films or layers of hardened adhesive which was permitted to set prior to bonding the adhesive-coated part to an adjacent part of the packet). A stoppage is likely to be necessary if a partially finished or finished pack blocks the path so that the bridge must be detached from or otherwise moved relative to the track in order to afford access to a damaged pack, to permit removal of the damaged pack or packs, and to reattach the bridge.

A likely location where a partly finished cigarette pack is apt to jam the path for successive packs is in the region of a paster which applies films of adhesive to blanks made, for example, of cardboard and already partially surrounding and confining metallic inner envelopes which can be made of metallic foil and surround an array of for example, twenty parallel plain or filter cigarettes. Films of adhesive are normally applied (such as sprayed) at least to lateral flaps of the aforementioned cardboard blanks which are to form part of hinged-lid packs of plain or filter cigarettes. In many instances, the application of adhesive films to lateral flaps of partially converted cardboard blanks takes place from below while the blanks advance along an elongated path defined in part by a track and in part by an elongated bridge which, in its normal operative position, overlies the track.

In many instances, a bridge is mounted in such a way that it can be pivoted to and from its operative position relative to the track. When in the operative position, the bridge is fixed to the track or to another support by metallic or other suitable fasteners. Such fasteners must be removed by hand (e.g., by means of a suitable tool) prior to pivoting of the bridge from the operative position, and the fasteners must be reapplied, again by hand, when the path is ready to guide successive packs from a first station to a second station. In addition to highly undesirable losses in output, frequent or even sporadic detachment of the bridge (or even a mere pivoting of the bridge to the inoperative position) results in wear upon the fasteners, misplacing of detached fasteners and other iconveniences (such as damage to component parts at the stations which are connected to each other by the track) which cannot be avoided in presently known packing machines or production lines employing one or more packing machines.

The likelihood of damage to parts which are installed at the station preceding and/or at the station following the path defined by the track and by the bridge can be avoided or reduced by removing such parts prior to movement of the bridge from the operative position to the inoperative position. However, such undertakings entail additional losses in output because a movement of the bridge from operative position must be preceded by removal of parts at the aforementioned station(s) and a movement of the bridge back to the operative position must be followed by reattachment of the parts to other devices at the respective station(s).

For example, if the track and the bridge cooperate to guide successive cardboard blanks or other types of blanks past one or more adhesive applying units (known as pasters) into the range of pushers which introduce adhesive-coated blanks and their contents into the pockets of an indexible blank converting wheel or turn-table, the bridge should be moved to its inoperative position when it cannot collide with one or more pushers for discrete packs or portions of packs. Similar situation can develop at the station where the path defined by the track and by the bridge (in the operative position of the bridge) is to receive blanks or partly finished packs for advancement toward and past one or more adhesive applying units. Attempts to employ a relatively short or very short removable or pivotable bridge have met with no success because such undertaking can affect the reliability of guidance of successive commodities from the station preceding to the station following the track.

OBJECTS OF THE INVENTION

An object of the present invention is to provide a method which ensures rapid, predictable, safe and convenient movements of the bridge between operative and inoperative positions relative to the track between two successive stations in a processing machine, such as a packing machine for cigarettes or other rod-shaped smokers' products.

Another object of the invention is to provide a method which can be carried out, as often as required, without it being necessary to dismantle the devices and/or units and/or groups of parts at the station(s) preceding and/or following the path defined by the track jointly with the bridge.

A further object of the invention is to provide a method which renders it possible to complete an inspection of the track for successive packs of cigarettes or other rod-shaped articles of the tobacco processing industry within a fraction of the time which is required for such undertaking in presently known packing machines.

An additional object of the invention is to provide a method which can be practiced in existing packing machines upon completion of relatively minor alterations involving solely the track and/or the bridge.

Still another object of the invention is to provide a method which renders it possible to greatly reduce the number of rejects in a packing machine for plain or filter cigarettes or the like.

A further object of the instant invention is to provide a novel and improved apparatus for the practice of the above outlined method.

Another object of the invention is to provide a novel and improved bridge for use in the above outlined apparatus.

An additional object of the invention is to provide a novel connection between the track and the bridge of the improved apparatus.

Still another object of the invention is to provide an apparatus which can be assembled into a module in the manufacturing plant and thereupon installed in an existing packing machine or in an existing production line employing one or more packing machines as a superior substitute for existing guiding apparatus.

A further object of the invention is to provide a novel and improved series of steps of manipulating the bridge prior to movement from and subsequent to return movement to the operative position relative to the track between successive processing stations in a packing machine for plain or filter cigarettes or other rod-shaped products of the tobacco processing industry.

Another object of the invention is to provide a packing machine which embodies or cooperates with one or more apparatus of the above outlined character.

SUMMARY OF THE INVENTION

One of several features of the present invention resides in the provision of a method of moving a variable-length bridge between an operative position in which the bridge is locked in an extended condition and cooperates with a track for the advancement of commodities from a first station to a second station in a packing machine. The improved method comprises the steps of unlocking the bridge, reducing the length of the bridge, and thereafter moving the bridge from the operative position to the inoperative position.

In accordance with one presently preferred embodiment, the bridge is elongated and has first and second end portions at least one of which is movable toward the other end portion. The length reducing step of the method which involves the manipulation of such bridge includes displacing the one end portion of the bridge toward the other end portion. The first and second end portions are respectively adjacent the first and second stations in the locked condition of the bridge, and the moving step can include displacing the one end portion of the bridge away from the respective (nearer) station. It is often preferred to resort to a moving step which includes displacing the first end portion of the bridge toward the second end portion and displacing the second end portion of the bridge toward the first end portion. More specifically, the moving step can include displacing the first end portion of the bridge toward the second end portion through a first distance, and displacing the second end portion of the bridge toward the first end portion through a distance which is different from the first distance. This can be accomplished in the following way: The moving step can include (a) displacing the first end portion of the bridge toward the second end portion and simultaneously displacing the second end portion of the bridge toward the first end portion, and (b) thereafter displacing one of the first and second end portions of the bridge. The step (a) includes or can include moving the first and second end portions of the bridge through at least substantially identical distances.

The unlocking step can include effecting the movement of at least one element of a composite locking device for the bridge along an at least partially non-linear path (e.g., along an arcuate path) to thus interrupt a force-locking retention of the bridge in the operative position.

The method normally further comprises the steps of returning the bridge from the inoperative position to the operative position subsequent to the moving step, thereafter increasing the length of the bridge to its normal or required length, and locking the bridge in the operative position.

The unlocking step is or can be carried out by hand. Alternatively, at least one of the steps can be carried out automatically, e.g., under the action of one or more prestressed springs. For example, the step of reducing the length of the bridge can be carried out in a plurality of successive stages at least one of which takes place or can take place in response to completion of the unlocking step.

Another feature of the present invention resides in the provision of a method of moving a variable-length bridge between an operative position in which the bridge is locked in an extended condition and cooperates with a track for the advancement of commodities from a first station to a second station in a packing machine, and a retracted position in which the bridge is unlocked and affords access to the commodities (e.g., parts of cigarette packs, partly finished cigarette packs or finished cigarette packs) in or on or at the track. The method comprises the steps of moving the bridge from the retracted position to the operative position, increasing the length of the bridge upon completion of the moving step, and locking the bridge upon completion of the length increasing step.

The bridge is or can be of the type having first and second end portions at least one of which is movable relative to the other end portion. The length increasing step of the method which is practiced by resorting to the just descibed bridge can include displacing the one end portion of the bridge away from the other end portion.

The first and second end portions of the bridge are or can be respectively spaced apart from the first and second stations upon completion of the moving step; the length increasing step of the method which is practiced by resorting to such bridge can include displacing the first and second end portions of the bridge toward the respective stations. In accordance with a presently preferred embodiment, the length increasing step includes displacing the first end portion of the bridge away from the second end portion and displacing the second end portion of the bridge away from the first end portion. More specifically, the length increasing step can include displacing the first end portion away from the second end portion through a first distance and displacing the second end portion away from the first end portion through a second distance which is different from the first distance. This can be carried out as follows: The length increasing step can include (a) displacing the first end portion of the bridge away from the second end portion and simultaneously displacing the second end portion of the bridge away from the first end portion, and (b) thereafter displacing one of the first and second end portions of the bridge away from the other of the first and second end portions. The displacing step (a) can include moving the first and second end portions of the bridge through at least substantially identical distances.

The locking step can include establishing a force-locking connection and/or a tight sliding fit between the bridge and the track or between the bridge and another stationary part of the packing machine. The locking step can but need not be carried out by hand.

Furthermore, the length increasing step can be carried out in several stages at least one of which preferably takes place in automatic response to completion of the moving step.

In accordance with a presently preferred embodiment, the locking step includes effecting a movement of at least one element or part of a composite locking device for the bridge along an at least partially non-linear path to thus establish a force-locking or another reliable retention of the bridge in the operative position.

The just described method normally further comprises the steps of unlocking (when necessary) the bridge in the operative position, thereafter reducing the length of the bridge, and thereafter moving the bridge from the operative position to the inoperative position (e.g., to afford access to the path which the track defines for a succession of finished or partly finished or incipient commodities).

A further feature of the instant invention resides in the provision of a combination of parts for use in a machine for confining successive commodities (such as partly finished cigarette packs) of a series of commodities in wrapping material. The combination of parts comprises a track which defines a path for advancement of successive commodities of the series from a first station to a second station, a mobile variable-length bridge adjacent the path and movable between an operative position in which the commodities in the path are less readily accessible (e.g., not accessible) and an inoperative position in which the commodities in the path are more readily (e.g., fully) accessible, and engageable and disengageable means for locking the bridge in at least one of its positions.

The bridge is or can be elongated and includes first and second end portions which are respectively adjacent the first and second stations in the operative and extended position of the bridge. At least one of these end portions is movable toward and away from the respective station to thus vary the length of the bridge.

In accordance with a presently preferred embodiment, the bridge comprises at least one slide or carriage including one of the first and second end portions of the bridge, and the at least one carriage is movable at least substantially lengthwise of the elongated bridge toward and away from the other end portion of the bridge, preferably upon disengagement of the locking means. The at least one carriage is moved away from the other end portion of the bridge to an extended position in which a component of the machine at the respective station prevents movement (or interferes or is likely to interfere with movement) of the bridge from the operative position. Such combination of parts can further include means for urging the at least one carriage toward the other end portion of the bridge so that the at least one carriage automatically moves toward the other end portion of the bridge upon disengagement of the looking means. The aforementioned urging means comprises or can comprise at least one resilient element (e.g., a tension spring).

The bridge preferably further comprises a second carriage which includes the other end portion of the bridge; such second carriage is movable at least substantially lengthwise of the elongated bridge toward and away from the one end portion of the bridge upon disengagement of the locking means. Such combination of parts preferably further includes means for respectively urging the at least one carriage and the second carriage toward the other and the one end portion of the bridge so that the at least one carriage and the second carriage automatically move toward the other end portion and toward the one end portion, respectively, in response to disengagement of the locking means. Still further, such combination of parts can include means for confining the at least one carriage to movement toward the other end portion of the bridge through a first distance and for confining the second carriage to movement toward the one end portion of the bridge through a second distance which at least approximates the first distance. The urging means can comprise at least one tension spring, and the just described combination of parts can further comprise means for maintaining the end portions of the bridge at a predetermined minimum distance from each other upon disengagement of the locking means and upon ensuing movement of the carriages by the urging means. The just mentioned means for maintaining the carriages at a predetermined minimum distance from each other can form part of the urging means or vice versa. For example, the urging means can comprise at least one substantially strip-shaped resilient element having a first portion affixed to the at least one carriage and a second portion affixed to the second carriage.

The bridge can be provided with a longitudinally extending window, and the locking means can comprise a displacing member which is connected with the at least one carriage and is movable in and longitudinally of the window to thus move the one end portion of the bridge relative to the other end portion.

The locking means can be constructed and assembled and installed in such a way that it is operable by hand. Such locking means can comprise a handle which is movable by hand between a locking position and an unlocking position. The handle and the bridge can be assembled and mounted in such a way that they are jointly pivotable between the operative and inoperative positions of the bridge subsequent to movement of the handle to the unlocking position.

The locking means can comprise at least one eccentric which is engageable with and disengageable from a complementary part of the locking means in the at least one position of the bridge, particularly in the operative position.

The novel features which are considered as characteristic of the invention are set forth in particular in the appended claims. The improved packing machine itself, however, both as to its construction and the modes of assembling and operating the same, together with numerous additional important and advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
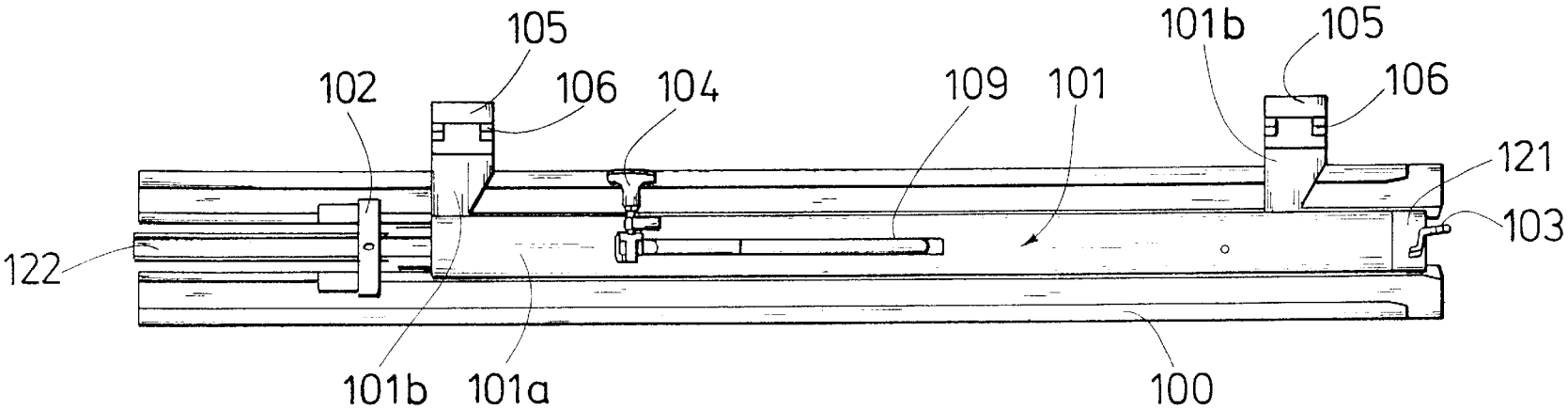
FIG. 1 is a schematic plan view of an apparatus which embodies one form of the present invention, the elongated bridge of the apparatus being shown in the fully extended locked operative position.

FIG. 1 shows an apparatus including an elongated track 100 which extends from a first station accommodating an indexible turntable including a part 103 to a second station accommodating a conveyor including one or more pushers 102 which can advance successive commodities to a processing station, not shown. The track 100 cooperates with an elongated variable-length cover or bridge 101 which is movable (pivotable) between an operative position shown, for example, in FIGS. 1 and 2 and an inoperative or retracted position shown in FIG. 9. When in the operative position, the bridge 101 defines with the track 100 an elongated path 130 (see FIG. 8) wherein successive commodities advance past one or more processing stations; such processing station(s) can be located beneath the track 100, above the bridge 101 or laterally adjacent the components 100, 101 of the improved apparatus.

Figure 2:
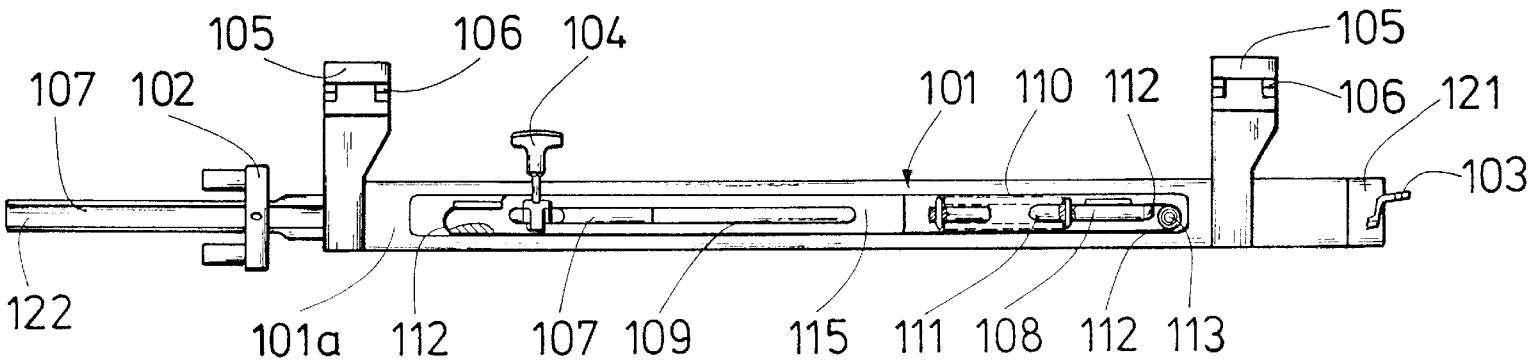
FIG. 2 shows the structure of FIG. 1 but with the track omitted.

Let it be assumed that the track 100 and the bridge 101 are installed in or that they cooperate with a cigarette packing machine. The turntable including or cooperating with the part 103 at the first station adjacent the end portion 121 of the bridge 101 (in the operative position of the bridge as shown in FIGS. 1 and 2) can serve to cooperate with one or more folding tools to carry out one or more deforming steps upon blanks (not shown) which are to be draped around successive groups or arrays of plain or filter cigarettes. The folding operation(s) which is or which are carried out by the turntable and one or more tools at the first station can be completed to such an extent that the envelope of each partly finished cigarette pack entering the path 130 between the track 100 and the bridge 101 at the end portion 121 of the bridge has one or more flaps positioned in such a way that the flap or flaps is or are coated with adhesive during advancement along or through the aforementioned paster(s) on the way between the first end portion 121 and the second end portion 122 of the bridge 101. The paster or pasters applies or apply adhesive to selected parts of successive blanks, and the respective partly finished cigarette packs are engaged by the oncoming pusher or pushers 102 for advancement to a location (e.g., onto or into a second turntable) where the conversion of partly finished cigarette packs progresses, e.g., by folding adhesive-coated flaps against the adjacent panels or walls of the respective blanks.

The commodities which are held in the packets of the turntable including or cooerating with the part 103 (e.g., an antenna) at the first station can include arrays of twenty cigarettes each, inner envelopes consisting of metalic foil, and cardboard blanks which are to be converted into the outer envelopes of so-called hinged-lid cigarette packs. The cardboard blanks receive films or sprays of adhesive (such as hotmelt) on their way along the path 130 defined by the track 100 in conjunction with the bridge 101 (in the operative position of the bridge), and the conversion of cardboard blanks into outer envelopes of hinged-lid cigarette packs is completed (at least in part) at the station adjacent the left-hand end portion 122 of the bridge shown in FIG. 1 or at the wrapping station which receives partly finished packs from successive pushers 102.

It happens, from time to time, that a partly finished cigarette pack blocks the path 130 between the track 100 and the bridge 101 and/or that an operator must gain access to the adhesive applying unit(s) which is or are adjacent such path. In the absence of any undertakings to the contrary, a simple pivoting or other movement(s) of the bridge 101 from the operative position of FIGS. 1 and 2 would necessitate extensive work in order to ensure that the bridge can be moved out of the way without damaging one or more parts at the first station adjacent the end portion 121 of the bridge, without damaging one or more parts (such as a pusher 102) at the station adjacent the end portion 122 of the bridge, and/or without damaging any portion or portions (e.g., the the end portion 121 and/or the end portion 122) of the bridge.

FIG. 2 is a plan view of the bridge 101 with the track 100 omitted. Furthermore, FIG. 2 does not illustrate certain parts of the bridge 101, namely those parts that would conceal the parts and groups of parts which are necessary for the practice of the novel methods and contribute to novelty of the bridge 101 (and hence to novelty of the entire apparatus). In accordance with an important feature of the present invention, the length of the bridge 101 is variable in that at least one of the end portions 121, 122 is movable lengthwise of the elongated bridge toward the other end portion. In a presently preferred embodiment, the end portion 121 is movable between the fully extended position shown in FIGS. 1, 2, 5 and the fully retracted position of FIGS. 3, 4, 6, 7, and the end portion 122 is movable between the fully extended position of FIGS. 1, 2, 3, 5 and the fully retracted position of FIGS. 4, 7.

An advantage of the variable-length bridge 101 is that the parts 103, 102 at the respective stations can remain in the illustrated positions without suffering damage and without causing damage to the respective end portions 121, 122 during movement of the bridge from or to the operative position of FIGS. 1 and 2. Furthermore, the undertaking involving a movement of the bridge 1l01 from the operative position to the retracted position or vice versa takes up a very short interval of time because the positions of parts at the end portions of the bridge can remain unchanged.

The apparatus or combination of parts including the track 100 and the bridge 101 further comprises a locking device or locking unit including a handle 104 and an eccentric 116. The handle 104 is movable (pivotable) from the operative or locking or engaged position of FIGS. 1, 2, 8 to the inoperative or disengaged or non-locking position of FIGS. 3, 4, 9, 10 and vice versa. Furthermore, the handle 104 shares the pivotal movements of the bridge 101 between the operative position of FIG. 8 and the inoperative or retracted position of FIG. 9.

The improved bridge 101 further comprises two slides or carriages 107, 108 which respectively include the end portions 122 and 121. The carriage 107 is movable longitudinally of the elongated main body portion 101*a* of the bridge 101 toward and away from the end portion 121 (i.e., toward and away from the carriage 108), and the carriage 108 is movable toward and away from the end portion 122 (i.e., toward and away from the carriage 107). The arrangement can be such that, if the bridge 101 is to be pivoted to the retracted position of FIG. 9, the carriages 107, 108 are first moved toward each other through at least substantially identical distances (compare FIGS. 5 and 6), and the carriage 107 is thereupon moved toward the carriage 108 through a greater second distance (compare FIGS. 6 and 7). The movement of the carriage 108 from the position of FIG. 5 to the position of FIG. 6 or 7 suffices to ensure that the end portion 121 of the shortened bridge 101 can bypass the part 103 during pivoting of the bridge between the operative and retracted positions respectively shown in FIGS. 8 and 9. The two movements of the carriage 107 from the position of FIG. 5, through the intermediate position of FIG. 6, and to the fully retracted position of FIG. 7 suffice to ensure that the end portion 122 of the twice shortened bridge 101 enables the bridge to bypass the nearest part (pusher) 102 at the left-hand station during pivotal movement of the bridge between the positions shown in FIGS. 8 and 9.

The main portion 101*a* of the bridge 101 comprises a guide 115 for the carriage 107. The latter comprises or can comprise a plurality of (e.g., two) sections which are movable relative to each other longitudinally of the bridge 101, i.e., longitudinally of the path for partially finished cigarette packs from the station including or accommodating the part 103 to the station including or accommodating the pusher 102. One section of the carriage 107 has an elongated slot 109, and the other section (shown at 120 in FIG. 8) of the carriage is operatively connected or associated with the handle 104 which is movable in the slot 109 longitudinally of the track 100.

Figure 3:
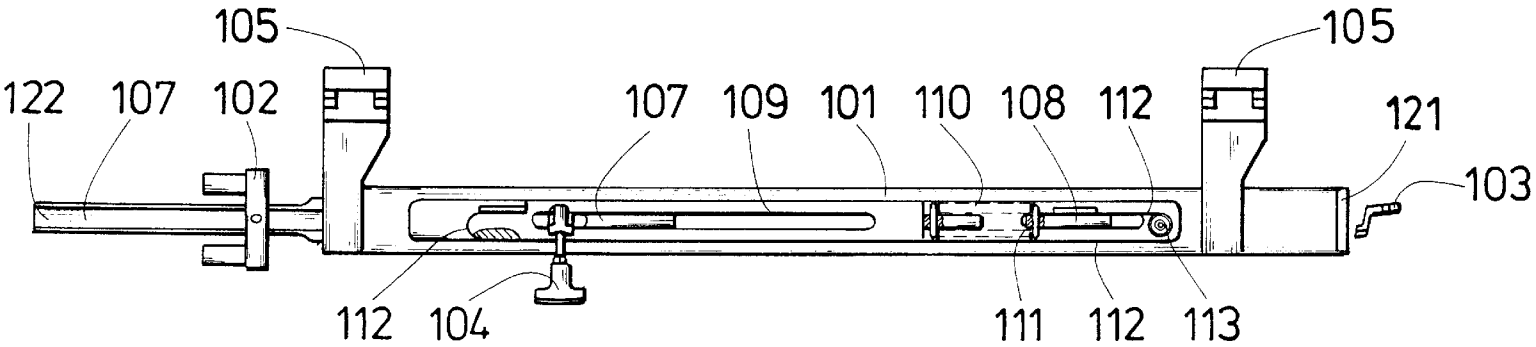
FIG. 3 is a plan view of the bridge but with the handle of the locking means for the bridge and for the carriages of the bridge in the inoperative position and with the carriages nearer to each other.

FIG. 3 shows the handle 104 in a position ready to move the respective section 120 of the carriage 107 (and hence the end portion 122 of the bridge 101) toward the carriage 108 and the right-hand end portion 121 of the bridge. This enables a tension spring 110, which urges the carriage 108 in a direction to the left, to shift this carriage against a stop 111. The bridge 101 further comprises a steel strip 112 which cooperates with the tension spring 110 to move the carriage 107 to the right. To this end, a first end portion of the strip 112 is affixed to the carriage 108, and intermediate portion of the strip is trained over a pulley 113 which is mounted in the main portion 101*a* of the bridge 101, and a second end portion of the strip is affixed to the carriage 107. The strip 112 ensures that, when the spring 110 is free to pull the carriage 108 to the left (to the extent determined by the stop 111), the carriage 107 is pulled to the right through a distance which matches or at least approximates the extent of longitudinal displacement of the carriage 108 and the end portion 121 away from the station located to the right of the bridge (as viewed in FIGS. 1 to 7). As already mentioned hereinbefore, such leftward movement of the carriage 108 from the end position shown in FIG. 3 suffices to ensure that the end portion 121 can bypass the part 103 during pivoting of the bridge 101 from the operative position of FIG. 8 to the retracted or inoperative position of FIG. 9 or vice versa.

Figure 4:
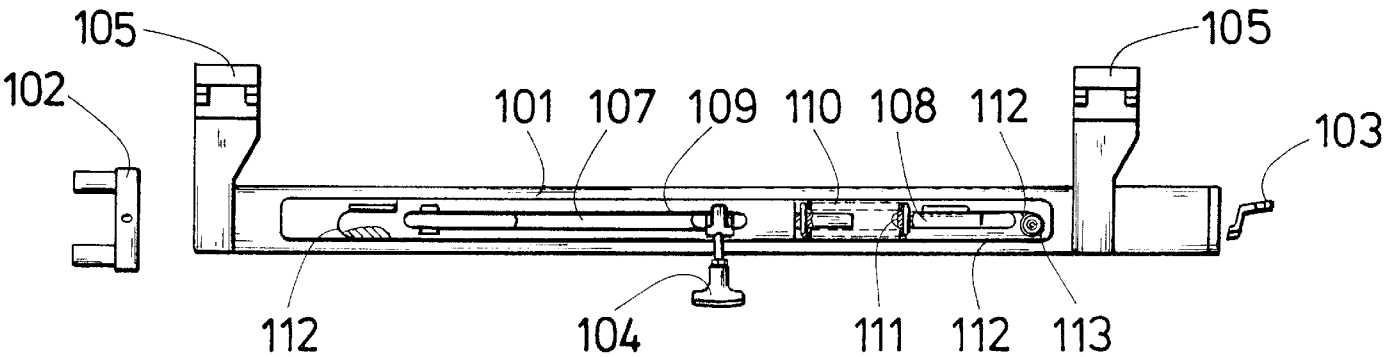
FIG. 4 is a plan view similar to that of FIG. 3 but with the left-hand carriage shifted toward the right-hand carriage to thus reduce the length of the bridge to a minimum value.
Figures 5, 6, 7:
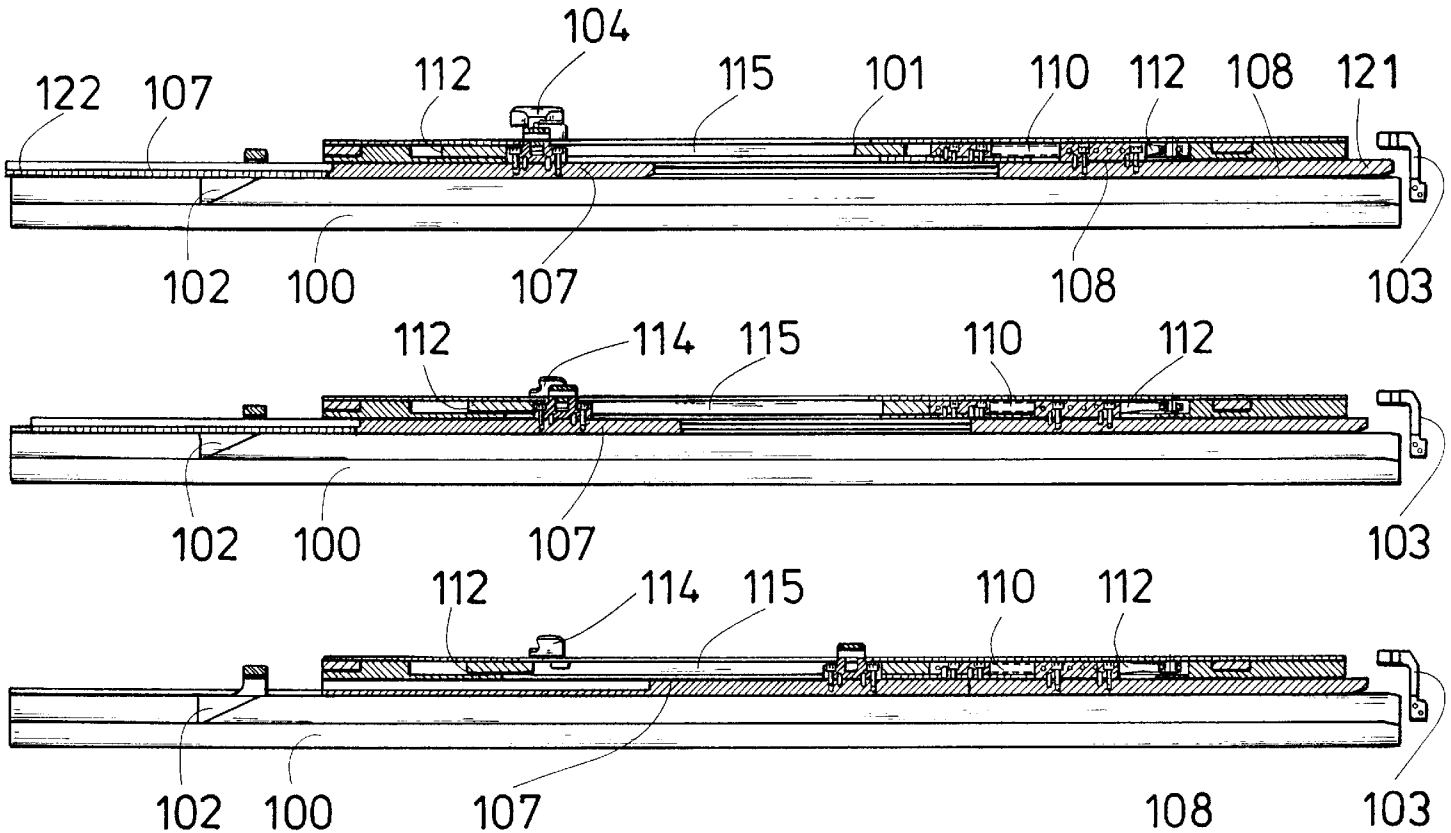
FIG. 5 is a partly elevational and partly longitudinal vertical sectional view of the apparatus with the carriages in the positions corresponding to those shown in FIG. 2.
FIG. 6 is a similar partly elevational and partly longitudinal vertical sectional view but with the carriages in positions corresponding to those shown in FIG. 3.
FIG. 7 is a similar partly elevational and partly longitudinal vertical sectional view but with the carriages in positions corresponding to those shown in FIG. 4.

FIGS. 4 and 7 show the bridge 101 upon completion of movement of the end portion 122 from the left-hand end position of FIGS. 1, 2, 3, 5, through the intermediate position of FIG. 6, and to the right-hand end position in which the carriage 107 and the end portion 122 can bypass the pusher 102 and/or any other part or parts at the station adjacent the left-hand end of the track 100. This is accomplished by moving the handle 104 of the locking device and the corresponding section 120 (including the end portion 122) of the carriage 107 in a direction to the right (as viewed in FIG. 3), i.e., toward the end portion 121 of the bridge 101. The position of the right-hand section (this section is provided with the slot 107) of the composite carriage 107 relative to the main portion 101*a* of the bridge 101 can remain unchanged.

The main portion 101*a* of the bridge 101 comprises two extensions 101*b* which can be said to constitute leaves of two axially spaced apart hinges mounted on bearing members 105 by means of coaxial pintles 106 defining a pivot axis for the bridge 101. The handle 104 can be used as a means for pivoting the bridge 101 between the operative position of FIG. 8, about the common axis of the pintles 106, and the retracted or inoperative position of FIG. 9.

The partly elevational and partly vertical longitudinal sectional view of FIG. 4 shows the components of the bridge 101 and the handle 104 in positions coresponding to those shown in FIG. 2. The same applies for the partly elevational and partly longitudinal vertical sectional view of FIG. 6 and the plan view of FIG. 3, as well as for the partly elevational and partly longitudinal vertical sectional view of FIG. 7 and the plan view of FIG. 4. A difference is that FIGS. 2 to 4 do not show but FIGS. 5 to 7 do show the track 100.

The spring 110, the steel strip 112, the stop 111 and the pulley 113 can be said to constitute parts of a composite device which serves to urge and move the carriages 107, 108 and the end portions 121, 122 of the bridge 101 toward each other (to the positions shown in FIGS. 3 and 6.) as soon as the locking unit 104, 116 is actuated to the extent which is necessary to pivot the handle 104 from the position of FIG. 2 to the position of FIG. 3. The next step in completing a shortening of the bridge 101 involves a movement of the handle 104 (and hence that of the left-hand section 120 of the carriage 107 and of the end portion 122) from the positions shown in FIGS. 3 and 6 to those shown in FIGS. 4 and 7.

The utilization of a bridge wherein one of the end portions is movable well beyond the respective end of the main portion is desirable and advantageous when the commodities being advanced along the path 120 defined by the track and the bridge must be reliably guided well beyond the respective end of the main portion. As can be seen by comparing the positions of the carriages 107, 108 in FIGS. 5 and 7, the extent of movement of the end portion 122 between its two end positions is many times that of the end portion 121. Such movements of the end portion 122 ensure that the carriage 107 can cooperate with the track 100 to properly advance a commodity well into the station which is adjacent the left-hand end of the track 100.

Figure 8:
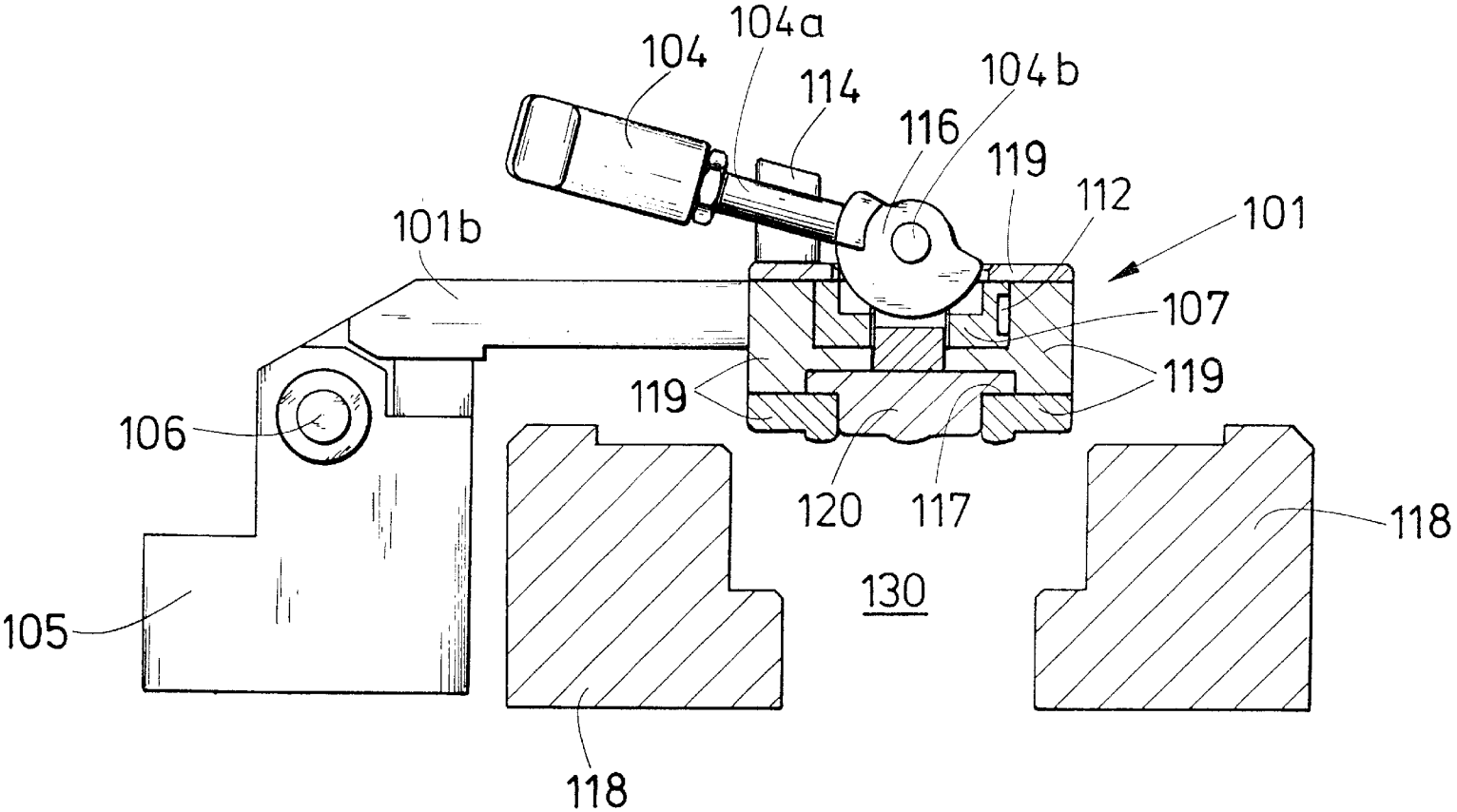
FIG. 8 is a greatly enlarged transverse vertical sectional view of the apparatus shown in FIG. 1.

FIG. 8 illustrates the guide members 118 of the track 100 and the guide members 119 forming part of the main portion 101*a* of the bridge 101. The two sets of guide members 118, 119 define the path 130 for successive commodities, such as the aforementioned partly finished or finished cigarete packs (not shown). Furthermore, the guide members 119 of the main portion 101*a* of the bridge 101 enable the two sections of the carriage 107 to move with and relative to each other between the positions shown in FIGS. 2, 3 and 4, i.e., between those shown in FIGS. 5, 6 and 7.

In FIG. 8, the handle 104 and its shank 104*a* are shown in the positions corresponding to those depicted in FIGS. 1, 2 and 5. The shank 104*a* is pivotable relative to the guide members 119 of the main portion 101*a* of the bridge 101 about the axis of a shaft 104*b* to thus change the angular position of the eccentric 116 which can establish a form-locking or force-locking (e.g., tight frictional) engagement between the mobile section 120 and the main portion 101*a* to thus maintain the carriage 107, in the end position which is shown in FIGS. 1 and 2.

The part denoted by the character 114 is a detent which can releasably hold the handle 104 and its shank 104*a* in the positions shown in FIGS. 1, 2, 4 and 8.

When the handle 104 is maintained in the locking position of FIG. 8, the section 120 is urged against the adjacent guide member or members 119 to hold the carriage 107 against movement lengthwise of the main portion 101*a* of the bridge 101. The curvature of the convex peripheral surface of the eccentric 116 is such that, when in the angular position of FIG. 8, the eccentric causes the section 120 of the carriage 107 to bear upon the adjacent guide members 119 and to thus lock the carriage 107 in the position of FIG. 2. On the other hand, when the handle 104 is pivoted to the angular position of FIG. 9, the eccentric 116 releases the section 120 and the prestressed spring 110 is free to move (in combination with the strip 112) the carriages 107, 108 from the positions shown in FIGS. 2 and 5 to those shown in FIGS. 3. and 6.

Figure 9:
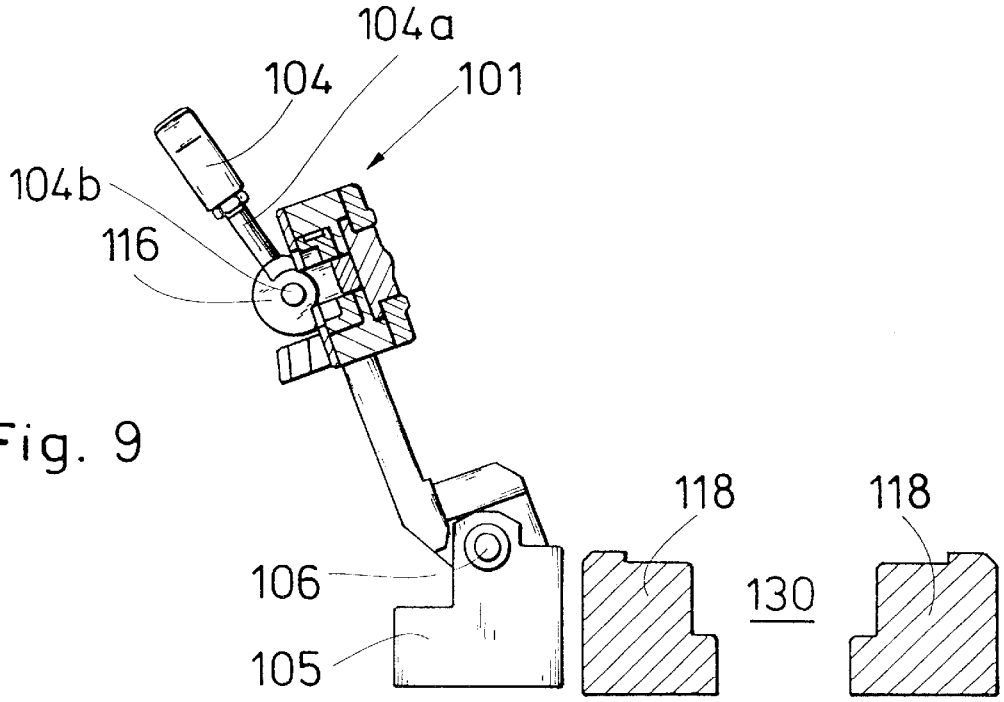
FIG. 9 is a smaller-scale transverse vertical sectional view but with the locking means for the carriages of the bridge in the inoperative positions and with the bridge shown in the retracted position.

Furthermore, and as can be seen by comparing its angular positions of FIGS. 8 and 9, the handle 104 can serve as a means for pivoting (at 106) the bridge 101 from the operative position (FIG. 8) to the retracted position (FIG. 9). The path 130 defined in part by the guide members 118 of the track 100 is then accessible for removal of jammed commodities, for access to the adhesive applying unit(s) beneath the guide members 118 of the track 100 and/or for other purposes.

Figure 10:
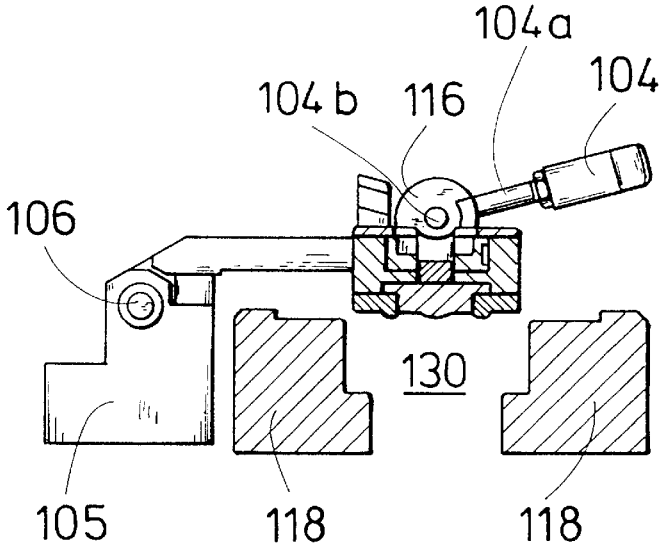
FIG. 10 shows the structure of FIG. 9 but with the bridge back in the operative position.

FIG. 10 shows the bridge 101 in the angular position of FIG. 8 but with the handle 104 pivoted (at 104*b*) relative to the bridge from the angular position of FIG. 8 to the angular position of FIG. 9. Thus, the eccentric 116 does not lock the mobile section 120 of the carriage 107 to the guide members 119 of the main portion 101*a* of the bridge 101. This enables an operator to shift the mobile section 120 of the carriage 107 and the handle 104 from the positions of FIGS. 4 and 7 to the positions of FIGS. 3 and 6, and thereupon from the positions of FIGS. 3 and 6 (against the opposition of the urging means including the spring 110 and the strip 112) back to the positions shown in FIGS. 2 and 5. This completes the lengthening of the bridge 101 from the minimum length shown in FIGS. 4 and 7 back to the full length of FIGS. 2 and 5.

To summarize: The bridge 101 is made ready for pivoting from the operative position of FIG. 8 to the retracted position of FIG. 9 by pivoting the handle 104 from the angular position of FIG. 2 to the angular position of FIG. 3 which enables the urging means 110, 112 to retract the carriages 107, 108 from the positions shown in FIGS. 2 and 5 to the positions shown in FIGS. 3 and 6. Shortening of the bridge 101 is completed by moving the handle 104 and the mobile section 120 of the carriage 107 from the positions shown FIGS. 3 and 6 to those shown in FIGS. 4 and 7. The handle is or can be utilized to thereupon pivot the bridge 101 from the operative position of FIG. 8 to the retracted position of FIG. 9. Alternatively, such pivoting of the bridge 101 can be carried out by hand.

In order to return the bridge 101 from the position of FIG. 9 to the position of FIG. 8, the handle 104 is manipulated to pivot the bridge from the position of FIG. 9 to that shown in FIG. 10. The next step involves a movement of the handle 104 longitudinally of the slot 109 from the position of FIG. 4 to the position of FIG. 3 and preferably immediately thereafter to the position of FIG. 2 (i.e., against the opposition of the spring 110) so that the carriages 107, 108 assume the outer end positions shown in FIG. 2. The last step involves locking the carriages 107, 108 in the end positions of FIG. 2 by pivoting the handle 104 (at 104*b*) from the angular position of FIG. 3 or 10 to the angular position of FIG. 2 or 8. This ensures that the eccentric 116 prevents the spring 110 from moving the carriages 107, 108 from the end positions shown in FIGS. 3 and 6.

The step of moving the handle 104 lengthwise between the positions shown in FIGS. 2, 5 and those shown in FIGS. 3, 6 (i.e., through substantially identical distances toward each other) can be omitted by training the strip 112 over two or more pulleys 113 in such a way that a movement of the carriage 108 from the position of FIG. 5 to the position of FIG. 6 automatically entails a (longer) movement of the carriage 107 from the position of FIG. 4 all the way to the position shown in FIG. 7. In the thus modified bridge, one end portion of the strip 112 can remain loose.

The improved apparatus can be simplified if the parts at one of the stations flanking the ends of the track 100 (e.g., the station for the part 103) are positioned in such a way that the respective end portion (121) of the bridge need not be moved toward the other end portion (122) In the thus modified bridge, the parts 108 and 110–113 can be omitted, and the handle 104 then serves as the only means for varying the length of the bridge.

It will be appreciated that the improved apparatus is susceptible of numerous additional modifications without departing from the spirit of the present invention. For example, the bridge 101 can be pivoted and/or lifted and/or lowered and/or moved sideways between its operative and retracted positions. Furthermore, the bridge can be lifted and thereupon pivoted about a vertical axis located midway between the ends of the main portion 101*a*, or the bridge can be lifted and thereupon moved sideways.

It is further possible to fully or partially motorize the movements of the handle 104 or another suitable part of the locking/unlocking and shifting means for the bridge. Savings in cost and bulk (i.e., in space requirements) of the apparatus can be achieved by resorting to the aforedescribed manually operable locking/unlocking and shifting (pivoting) means for the bridge.

Furthermore, the spring 110 can be replaced with a fluid-operated (such as a pneumatic) cylinder and piston motor which is set up to operate with a fluid at subatmospheric and/or superatmospheric pressure, e.g., to move the carriages 107, 108 longitudinally of the bridge 101 and toward each other in response to pivoting and/or other movements of the handle 104 or an analogous part to a lock-disengaging position. This can cause the piston of the fluid-operated motor to move from a plenum chamber toward a suction chamber and to thereby shift the carriages 107, 108 toward each other, e.g., through at least, substantially identical distances or through different distances, depending upon the nature and/or distribution of parts at the stations flanking the track 100 or an equivalent guide means. Another motor (e.g., a second fluid-operated cylinder and piston unit) can be utilized to move the bridge between its operative and retracted positions.

Another packing machine wherein the apparatus of the present invention can be put to use is disclosed in commonly owned copending U.S. patent application Ser. No. 09/678,671 filed Oct. 4, 2000 by Jürgen GROSSMANN and for Hortnut Meis for "METHOD OF AND APPARATUS FOR MAKING PACKETS FOR ARRAYS OF DISCRETE COMMODITIES".

Without further analysis, the foregoing will so fully reveal the gist of the present invention that others can, by applying current knowledge, readily adapt it for various applications without omitting features that, from the sandpoint of prior art, fairly constitute essential characteristics of the generic and specific aspects of he above outlined contribution to the art of making and operating packing machines for cigarettes or the like and, therefore, such adaptations should and are intended to be comprehended within the meaning and range of equivalence of the appended claims.

What is claimed is:

1. A method of moving a variable-length guide between an operative position in which the guide is locked in an extended condition and cooperates with a track for the advancement of commodities from a first station to a second station in a packing machine, and a retracted position in which the guide affords access to commodities at the track, comprising the steps of:

unlocking the guide;

reducing the length of the guide;

and thereafter moving the guide from the operative position to the inoperative position.

2. The method of claim 1 of moving an elongated guide having first and second end portions at least one of which is movable toward the other end portion, wherein said length reducing step includes displacing the one end portion of the guide toward the other end portion.

3. The method of claim 2 of moving a guide wherein the first and second end portions are respectively adjacent the first and second stations in the locked condition of the guide, wherein said moving step includes displacing the one end portion of the guide away from the respective station.

4. The method of claim 2, wherein said moving step includes displacing the first end portion toward the second end portion and displacing the second end portion toward the first end portion.

5. The method of claim 2, wherein said moving step includes displacing the first end portion toward the second end portion through a first distance and displacing the second end portion toward the first end portion through a second distance different from the first distance.

6. The method of claim 2, wherein said moving step includes (a) displacing the first end portion toward the second end portion and simultaneously displacing the second end portion toward the first end portion, and (b) thereafter displacing one of the first and second end portions toward the other of the first and second end portions.

7. The method of claim 6, wherein the displacing step (a) includes moving the first and second end portions of the guide through at least substantially identical distances.

8. The method of claim 1, wherein the unlocking step includes effecting a movement of at least one element of a composite locking device for the guide along an at least partially non-linear path to thus interrupt a force-locking retention of the guide in the operative position.

9. The method of claim 1, further comprising the steps of:

returning the guide from the inoperative position to the operative position subsequent to said moving step;

thereafter increasing the length of the guide; and locking the guide in the operative position.

10. The method of claim 1, wherein said unlocking step is carried out by hand.

11. The method of claim 1, wherein said length reducing step is carried out in a plurality of stages at least one of which takes place in automatic response to completion of said unlocking step.

12. A method of moving a variable-length guide between an operative position in which the guide is locked in an extended condition and cooperates with a track for the advancement of commodities from a first station to a second station in a packing machine, and a retracted position in which the guide is unlocked and affords access to the commodities in the track, comprising the steps of:

moving the guide from the retracted position to the operative position;

increasing the length of the guide upon completion of the moving step; and locking the guide upon completion of the length increasing step.

13. The method of claim 12 of moving an elongated guide having first and second end portions at least one of which is movable relative to the other end portion, wherein said length increasing step includes displacing the one end portion of the guide away from the other end portion.

14. The method of claim 13 of moving a guide wherein the first and second end portions are respectively spaced apart from the first and second stations upon completion of said moving step, said length increasing step including displacing the first and second end portions of the guide toward the respective stations.

15. The method of claim 13, wherein said length increasing step includes displacing the first end portion of the guide away from the second end portion and displacing the second end portion of the guide away from the first end portion.

16. The method of claim 13, wherein said length increasing step includes displacing the first end portion of the guide away from the second end portion through a first distance and displacing the second end portion of the guide away from the first end portion through a second distance different from the first distance.

17. The method of claim 13, wherein said length increasing step includes (a) displacing the first end portion of the guide away from the second end portion and simultaneously displacing the second end portion of the guide away from the first end portion, and (b) thereafter displacing one of the first and second end portions of the guide away from the other of the first and second end portions.

18. The method of claim 17, wherein the displacing step (a) includes moving the first and second end portions of the guide through at least substantially identical distances.

19. The method of claim 12, wherein said locking step comprises establishing a force-locking connection between the guide and the track.

20. The method of claim 12, wherein said locking step comprises establishing a tight sliding fit between the guide and the track.

21. The method of claim 12, wherein said locking step is carried out by hand.

22. The method of claim 12, wherein said length increasing step is carried out in a plurality of stages at least one of which takes place in automatic response to completion of said moving step.

23. The method of claim 12, wherein the locking step includes effecting a movement of at least one element of a composite locking device for the guide along an at least partially non-linear path to thus establish a force-locking retention of the guide in the operative position.

24. The method of claim 12, further comprising the steps of:

unlocking the guide in the operative position;

thereafter reducing the length of the guide; and moving the guide from the operative position to the retracted position subsequent to completion of said length reducing step.

25. In a machine for confining successive commodities of a series of commodities in wrapping material, a combination comprising:

a track defining a path for advancement of successive commodities of the series from a first station to a second station;

a mobile variable-length guide adjacent said path and movable between an operative position in which the commodities in said path are less readily accessible and an inoperative position in which the commodities in said path are more readily accessible; and engageable and disengageable means for locking said guide in at least one of said positions.

26. The structure of claim 25, wherein said guide is elongated and includes first and second end portions respectively adjacent the first and second stations in the operative position of the guide, at least one of said end portions being movable toward and away from the respective station to thus vary the length of the guide.

27. The structure of claim 25, wherein said guide is elongated and has first and second end portions respectively adjacent the first and second stations in the operative position of the guide, said guide comprising at least one carriage including one of said first and second end portions and said at least one carriage being movable at least substantially lengthwise of the guide toward and away from the other of said end portions upon disengagement of said locking means.

28. The structure of claim 27, wherein said at least one carriage is movable away from said other end portion to an extended position in which a component of the machine at the respective station prevents movement of said guide from said operative position.

29. The structure of claim 27, further comprising means for urging said at least one carriage toward said other end portion of said guide so that the at least one carriage automatically moves toward said other end portion of the guide upon disengagement of said locking means.

30. The structure of claim 29, wherein said urging means comprises at least one resilient element.

31. The structure of claim 27, wherein said guide further comprises a second carriage including said other end portion, said second carriage being movable at least substantially lengthwise of said guide toward and away from said one end portion upon disengagement of said locking means.

32. The structure of claim 31, further comprising means for respectively urging said at least one carriage and said second carriage toward said other and said one end portion so that said at least one carriage and said second carriage automatically move toward said other end portion and toward said one end portion, respectively, in response to disengagement of said locking means.

33. The structure of claim 32, further comprising means for confining said at least one carriage to movement toward said other end portion of the guide through a first distance and for confining said second carriage to movement toward said one end portion of the guide through a second distance at least approximating said first distance.

34. The structure of claim 32, wherein said urging means comprises at least one tension spring.

35. The structure of claim 32, further comprising means for maintaining said end portions of said guide at a predetermined minimum distance from each other upon disengagement of said locking means and upon ensuing movement of said carriages by said urging means.

36. The structure of claim 35, wherein said means for maintaining forms part of said urging means.

37. The structure of claim 36, wherein said urging means comprises at least one substantially strip-shaped flexible element having a first portion affixed to said at least one carriage and a second portion affixed to said second carriage.

38. The structure of claim 27, wherein said guide has a longitudinally extending window and said locking means comprises a displacing member connected with said at least one carriage and movable in and longitudinally of said window to thus move said one end portion relative to said other end portion of the guide.

39. The structure of claim 25, wherein said locking means is operable by hand.

40. The structure of claim 39, wherein said locking means comprises a handle movable by hand between a locking position and an unlocking position.

41. The structure of claim 40, wherein said handle and said guide are pivotable between said operative and inoperative positions subsequent to movement of said handle to said unlocking position.

42. The structure of claim 25, wherein said locking means comprises at least one eccentric engageable with and disengageable from a complementary part of said locking means in said at least one position of said guide.

* * * * *